US008468724B2

(12) United States Patent
Leslie et al.

(10) Patent No.: US 8,468,724 B2
(45) **Date of Patent: *Jun. 25, 2013**

(54) MOUNTING OF WEAR MEMBERS

(75) Inventors: Bruce Alexander Leslie, Goodna (AU); Simon Peter Orton, Highland Park (AU); Benjamin Charles Plant, Rocklea (AU); Roderick Mark Bolt, Kensington Park (AU)

(73) Assignee: CQMS Pty Ltd, Queensland (AU)

( * ) Notice: Subject to any disclaimer, the term of this patent is extended or adjusted under 35 U.S.C. 154(b) by 411 days.

This patent is subject to a terminal disclaimer.

(21) Appl. No.: 12/593,608

(22) PCT Filed: Feb. 29, 2008

(86) PCT No.: PCT/AU2008/000268

§ 371 (c)(1),
(2), (4) Date: Mar. 8, 2010

(87) PCT Pub. No.: WO2008/119102

PCT Pub. Date: Oct. 9, 2008

(65) Prior Publication Data

US 2010/0162595 A1 Jul. 1, 2010

(30) Foreign Application Priority Data

Mar. 29, 2007 (AU) ..... 2007901686

(51) Int. Cl.
*E02F 9/28* (2006.01)

(52) U.S. Cl.
USPC ..... 37/456; 172/722

(58) Field of Classification Search
USPC ..... 37/455, 456, 449, 450, 451, 452, 37/453, 454, 457, 458, 459; 172/772, 772.5
See application file for complete search history.

(56) References Cited

U.S. PATENT DOCUMENTS

| | | | | |
|---|---|---|---|---|
| 943,775 | A * | 12/1909 | Exton et al. | 37/454 |
| 3,774,324 | A | 11/1973 | Lanfond | |
| 3,839,805 | A | 10/1974 | Stepe | |

(Continued)

FOREIGN PATENT DOCUMENTS

| | | |
|---|---|---|
| AU | 2003264586 | 7/2004 |
| CA | 2161505 | 4/1997 |
| GB | 1476822 | 6/1977 |

OTHER PUBLICATIONS

International Search Report from PCT/AU2008/000268 dated Mar. 17, 2008.

*Primary Examiner* — Jamie L McGowan
(74) *Attorney, Agent, or Firm* — Wong, Cabello, Lutsch, Rutherford & Brucculeri, L.L.P.

(57) ABSTRACT

A retaining pin assembly for an excavator tooth assembly. The retaining pin assembly has opposable locating members each having a shank portion able to be slidably insertable via a respective retaining pin aperture on opposite sides of a wear member into a transversely extending mounting aperture of a mounting nose of an excavator. Each locating member also has an enlarged inwardly convergent tapered wedge portion adjacent a normally outer end. The retaining pin assembly also has a tensionable retaining member extending between the locating members from one side of the retaining pin assembly. When tension is applied to the retaining member relative contraction of the locating members occurs to urge the wear member into engagement with the mounting nose by wedging engagement between each of the wedge portions and a rear wall of respective retaining pin apertures.

21 Claims, 6 Drawing Sheets

U.S. PATENT DOCUMENTS

| | | | | | |
|---|---|---|---|---|---|
| 3,982,339 | A | | 9/1976 | Nilsson | |
| 4,182,058 | A | | 1/1980 | Poncin | |
| 4,231,173 | A | | 11/1980 | Davis | |
| 4,233,761 | A | | 11/1980 | Ryerson | |
| 4,338,736 | A | | 7/1982 | Radigan | |
| 4,404,760 | A | | 9/1983 | Hahn et al. | |
| 4,433,496 | A | | 2/1984 | Jones et al. | |
| 4,587,751 | A | | 5/1986 | Sjogren et al. | |
| 4,903,420 | A | | 2/1990 | Kreitzberg et al. | |
| 5,077,918 | A | | 1/1992 | Garman | |
| 5,088,214 | A | | 2/1992 | Jones | |
| 5,172,501 | A | | 12/1992 | Pippins | |
| 5,272,824 | A | | 12/1993 | Cornelius | |
| 5,337,495 | A | | 8/1994 | Pippins | |
| 5,410,826 | A | * | 5/1995 | Immel et al. | 37/457 |
| 5,423,138 | A | | 6/1995 | Livesay et al. | |
| 5,452,529 | A | * | 9/1995 | Neuenfeldt et al. | 37/455 |
| 5,469,648 | A | | 11/1995 | Jones et al. | |
| 5,564,206 | A | * | 10/1996 | Ruvang | 37/458 |
| 5,638,621 | A | | 6/1997 | Keech | |
| 5,653,048 | A | | 8/1997 | Jones et al. | |
| 5,709,043 | A | | 1/1998 | Jones | |
| 5,784,813 | A | * | 7/1998 | Balassa et al. | 37/455 |
| 5,868,518 | A | | 2/1999 | Chesterfield | |
| 5,909,962 | A | | 6/1999 | Livesay et al. | |
| 5,937,550 | A | | 8/1999 | Emrich | |
| 6,009,644 | A | | 1/2000 | Hedley | |
| 6,018,896 | A | | 2/2000 | Adamic | |
| 6,052,927 | A | | 4/2000 | Pippins | |
| 6,119,378 | A | | 9/2000 | Pippins | |
| 6,393,739 | B1 | * | 5/2002 | Shamblin et al. | 37/456 |
| 6,467,203 | B2 | | 10/2002 | Pippins | |
| 6,467,204 | B1 | | 10/2002 | Creighton et al. | |
| 6,735,890 | B2 | | 5/2004 | Carpenter et al. | |
| 7,036,249 | B2 | * | 5/2006 | Mautino | 37/457 |
| 7,100,315 | B2 | | 9/2006 | Carpenter et al. | |
| 7,313,877 | B2 | * | 1/2008 | Clendenning et al. | 37/456 |
| 7,603,799 | B2 | * | 10/2009 | Campomanes | 37/456 |
| 7,681,341 | B2 | * | 3/2010 | Ruvang | 37/456 |
| D634,605 | S | * | 3/2011 | Guimaraes | D8/343 |
| 2002/0000053 | A1 | | 1/2002 | Adamic | |
| 2005/0274047 | A1 | * | 12/2005 | Pippins | 37/455 |
| 2010/0229433 | A1 | * | 9/2010 | Leslie et al. | 37/456 |

* cited by examiner

MOUNTING OF WEAR MEMBERS

CROSS-REFERENCE TO RELATED APPLICATION

The present application is a National Stage entry from PCT Patent Application No. PCT/AU2008/000268 filed on 29 Feb. 2008, which claims priority to Australian Application 2007901686 filed on 29 Mar. 2007 the contents of each one incorporated herein by reference.

FIELD OF THE INVENTION

This invention is concerned with improvements in mounting of wear members to earth excavating devices.

The invention is concerned particularly, although not exclusively, with the mounting of excavator teeth adaptors to adaptor noses on an excavating device such as an excavator bucket or the like.

BACKGROUND OF THE INVENTION

Excavator tooth assemblies mounted to the digging edge of excavator buckets and the like generally comprise a replaceable digging point, an adaptor body and an adaptor nose which is secured by welding or the like to the digging edge of a bucket or the like. The adaptor has a socket-like recess at its rear end to receivably locate a front spigot portion of the adaptor nose and a removable locking pin extends through aligned apertures in the adaptor and nose to retain the adaptor in position.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/toothcombination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of an adaptor to a nose, most of these proposals suffer from one or more deficiencies. As described hereinafter, many of the prior art references relate to direct mounting of a tooth onto an adaptor without an intermediate adaptor but in those assemblies, the mounting systems for securing teeth directly onto excavator noses is considered analogous to the mounting of an adaptor onto a nose.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No US 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. No. 5,172,501 and U.S. Pat. No. 6,052,927. Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No 2003264586 describes a locking pin assembly comprising a body member having a non-circular cross-sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

While generally satisfactory for their intended purpose, the abovementioned prior art nose/adaptor (or nose/tooth equivalent) combinations all suffer from one or more shortcomings or disadvantages in terms of inadequate resistance to rotation of an adaptor off a nose under the influence of vertical loads applying a rotational moment to the adaptor, a predisposition to premature wear, difficulties in retention of the adaptors on noses, inadequate locking systems and unduly complicated configurations giving rise to increased fabrication costs.

It is an aim of the present invention to overcome or alleviate at least some of the abovementioned prior art disadvantages or otherwise to provide consumers with a convenient choice.

SUMMARY OF THE INVENTION

According to one aspect of the invention, there is provided an excavator tooth assembly comprising:

a mounting nose projectable from a digging edge of an excavator, said mounting nose including a mounting aperture extending laterally of said nose between opposite side walls thereof, said mounting aperture having a non-circular cross-section;

a wear member having a longitudinal axis, a forward end and a rearwardly opening socket for receiving said mounting nose, said wear member including opposed wall apertures communicating with a hollow interior of said socket, said opposed wall apertures, in use, being at least partially alignable with said mounting aperture; and, a retaining pin assembly, in use, non-rotatably located in said mounting aperture, said retaining pin assembly including locating members insertable via respective opposed wall apertures for slidable location in said mounting aperture, said locating members being retainable in said assembly by a tensionable retaining member extending between said locating members whereby an enlarged free end of each locating member is engagable with a wall of respective wall aperture.

Suitably, said mounting aperture may include a generally oval-shaped cross-section.

Preferably, said mounting aperture may include a generally tear drop shaped cross-section.

Optionally, said opposed wall apertures may have a generally oval shape.

A longitudinal dimension of said opposed wall apertures may be greater than the longitudinal dimension of the mounting aperture.

Suitably, at least a portion of a wall of at least one of said opposed wall apertures has an inwardly convergent tapered portion.

According to another aspect of the invention, there is provided a retaining pin assembly for an excavator tooth assembly, said retaining pin assembly comprising:— opposable locating members each comprising a shank portion, in use, slidably insertable via a respective retaining pin aperture on opposite sides of a wear member into a transversely extending mounting aperture of a mounting nose of an excavator, said locating members each having an enlarged inwardly convergent tapered wedge portion adjacent a normally outer end of a respective locating member; and a tensionable retaining member extending between said opposable locating members from one side of said retaining pin assembly whereby, in use, tension applied to said retaining member causes relative contraction of said locating members to urge said wear member into engagement with said mounting nose by wedging engagement between each said wedge portion and a rear wall of respective retaining pin apertures.

Suitably, each said shank portion and said complementary mounting aperture are of non-circular cross-sectional shaped.

If required, said retaining pin assembly may include a body member located intermediate of said locating members, said body member including an aperture extending longitudinally thereof to accommodate said tensionable retaining member.

The body member and said mounting aperture may be of complementary non-circular cross-sectional shapes.

Preferably, said body member comprises a longitudinally extending body aperture to slidably locate in opposite ends thereof, respective shank portions of said locating members.

If required, said body aperture may include a centrally located abutment.

Preferably, said shank portion of each said locating member slidably locatable in said body member has a cross-sectional shape complementary to said cross-sectional shape of said body aperture.

Suitably, said tensionable retaining member comprises a screw-threaded fastener.

The screw-threaded fastener may be captively located in a slotted aperture in one of said locating members.

Suitably, a driver engageable head of said screw-threaded fastener is accessible via a longitudinally extending bore extending between opposite ends of one of said locating members.

Preferably, said retaining pin assembly includes a plug member removably locatable in said longitudinally extending bore.

According to a still further aspect of the invention, there is provided a method of removably securing a wear member to a projecting mounting nose of a digging edge of an excavator, said method comprising the steps of:— locating on said mounting nose, a wear member having opposed wall apertures at least partially alignable with said mounting aperture;

inserting through one said opposed wall aperture, a locating member having a screw-threaded aperture at an inner end and an enlarged outer end thereof;

inserting through an opposite opposed wall aperture, a further locating member having a screw-threaded fastener located therein, a threaded end of said screw-threaded fastener extending beyond an inner end of said further locating member, a drivable head of said screw-threaded fastener being accessible via a bore extending through an enlarged outer end of said further locating member; and, coupling said screw-threaded fastener with said screw-threaded aperture of said one locating member whereby tensioning of said screw-threaded member causes relative contraction between said one locating member and said further locating member to prevent disengagement of said wear member.

Suitably, said enlarged outer ends of said locating members include inwardly convergent tapered portions which engage against respective walls of said opposed wall apertures in said wear member to urge said wear member into engagement with said nose when said screw-threaded fastener is tensioned.

Preferably, said opposed wall apertures each include a complementary tapered portion engageable with respective tapered portions of said locating members to urge said wear member into engagement with said nose when said screw-threaded fastener is tensioned.

If required, said further locating member may include an apertured abutment engageable with a head of said screw-threaded fastener whereby, in use, unscrewing of said fastener urges said locating members apart.

Throughout this specification, unless the context requires otherwise, the word "comprise", and variations such as "comprises" or "comprising", will be understood to imply the inclusion of a stated integer or group of integers or steps but not the exclusion of any other integer or group of integers.

BRIEF DESCRIPTION OF DRAWINGS

In order that the various aspects of the invention may be readily understood and put into practical effect, reference will now be made to preferred embodiments illustrated in the accompanying drawings in which:—

In the accompanying drawings, like numerals have been employed for like features for the sake of simplicity of description.

DETAILED DESCRIPTION OF THE DRAWINGS

Figure 1:
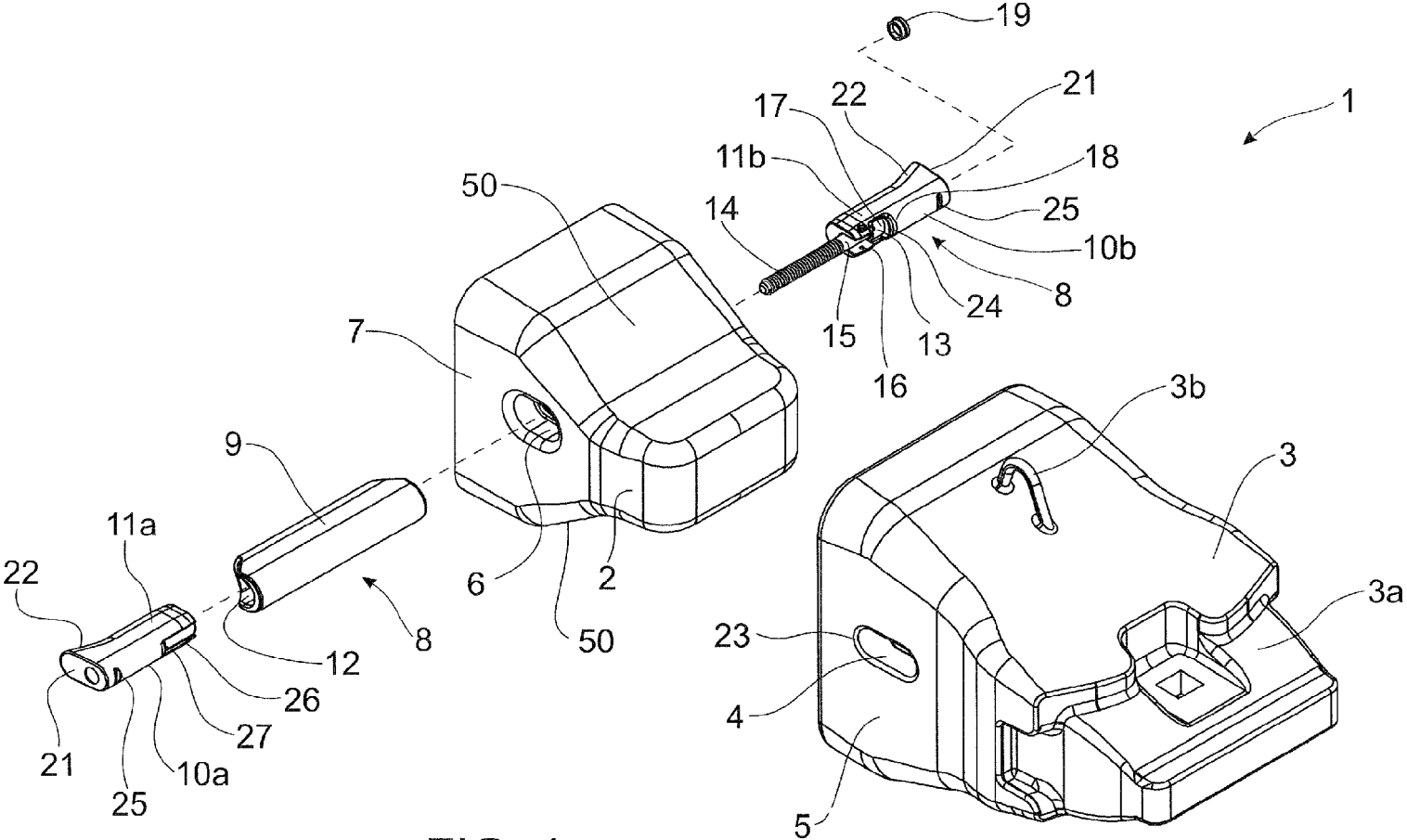
FIG. 1 shows an exploded view of an excavator tooth assembly.

In FIG. 1, the excavator tooth assembly 1 comprises a mounting nose 2, in use, normally mounted on or integrally formed with a cutting edge (not shown) of an excavator bucket or the like (also not shown). As illustrated, only the front portion of nose 2 is shown. Slidably engageable over nose 2 is a wear member in the form of an adaptor 3. Located in the rear portion of adaptor 3 is a socket aperture (not shown) having an internal shape generally complementary to the front portion of nose 2 illustrated. Adaptor 3 includes a front formation 3*a* to accept replaceable digging teeth or points (not shown). A hoist loop 3*b* is mounted on the top of adaptor 3 to enable ease of handling by a hoist during attachment and detachment operations.

When adaptor 3 is engaged on nose 2,opposed wall apertures in the form of side wall apertures 4 in opposed side walls 5 of adaptor 3 are at least partially aligned with a mounting aperture 6 which extends between opposite side walls 7 of nose 2. Both apertures 4 and 6 are of a generally oval cross-sectional shape to locate a retaining pin assembly shown generally at 8 in an exploded state.

Retaining pin assembly 8 comprises a hollow body member 9 having a cross-sectional shape complementary to that of aperture 6 in nose 2 and allows body member 9 to be slidably but non-rotatably located in aperture 4. Assembly 8 also includes locating members 10*a*, 10*b*, each having a shank portion 11*a*, 11*b* slidably locatable within the hollow interior aperture 12 extending between opposite ends of body 9. Interior aperture 12 has a cross-sectional shape complementary to the cross-sectional shape of shank portions 11*a*, 11*b*.

Captively located in a recess 13 in shank portion 11*b* of locating member 10*b* is a tensionable retaining member which in the embodiment is in the form of a threaded bolt 14 which is inserted from the side with a shank portion 15 in a slot 16 and the screw head 17 located in an enlarged recess 18. A resilient plug 19 is insertable into an axial bore (not shown) aligned with a drivable portion of the screw head 17 to seal the bore against the ingress of moisture and/or earthen materials. The outer ends of locating members 10*a*, 10*b* respectively include a cross-sectionally enlarged portion 21 having an inwardly convergent tapered portion 22, the purpose of which will be described later.

In order to secure the adaptor 3 to nose 2, the body member 9 of retaining pin assembly 8 is slid into aperture 6 of nose 2 such that neither end of body member protrudes beyond opposed side walls 7. Adaptor 3 is then engaged over nose 2 and locating members 10*a* and 10*b* with captively located bolt 14 are inserted, via opposed side wall apertures 4 in adaptor 3, into opposite ends of body member 9. A hexagonal drive member (not shown) is inserted via the axial bore in the end of locating member 10*b* to engage the driver portion of the head 17 of bolt 14.

As bolt 14 rotates, it engages an aligned threaded bore (not shown) in the shank portion 11*a* of locating member 10*a* to cause locating members 10*a*, 10*b* to move inwardly relative to each other. When tapered portions 22 of locating members 10*a*, 10*b* wedgingly engage against the rearward walls 23 of respective apertures 4 in adaptor 3, they urge adaptor 3 into tight engagement with nose 2.

To remove adaptor 3 from nose 2, the drive member (not shown) of a drive apparatus (also not shown) is engaged with the driver portion of the head 17 of bolt 14 and the bolt is rotated in a direction reverse to the tightening direction. As the head 17 bears on a rear wall 24 of recess 18, locating members 10*a*, 10*b* are urged apart in a relative sense. If only one of locating members 10, 10*b* moves relative to adaptor 3, it may be allowed to retract a predetermined distance before giving it a tap with a hammer or the like to loosen the other locating member before fully withdrawing the initially movable locating member. In the event that one of the locating members is difficult to remove due to tightly packed earthen fines or cementation thereof, an impacting tool (not shown) may be engaged in inwardly inclined slots 25 in locating members 10*a*, 10*b* to assist in removal thereof from body member 9. Although not prone to wear, body member 9 is readily removable from aperture 6 in nose 2 in the event that replacement or maintenance is necessitated.

On the inner forward surfaces of locating member 10*a* is a flatted indentation 26 having a shouldered abutment 27 at one end thereof. The purpose of this indentation 26 and shouldered abutment 27 will be described later. A similar formation exists with slot 16, recess 18 and wall 24 of recess 18.

Figure 2:
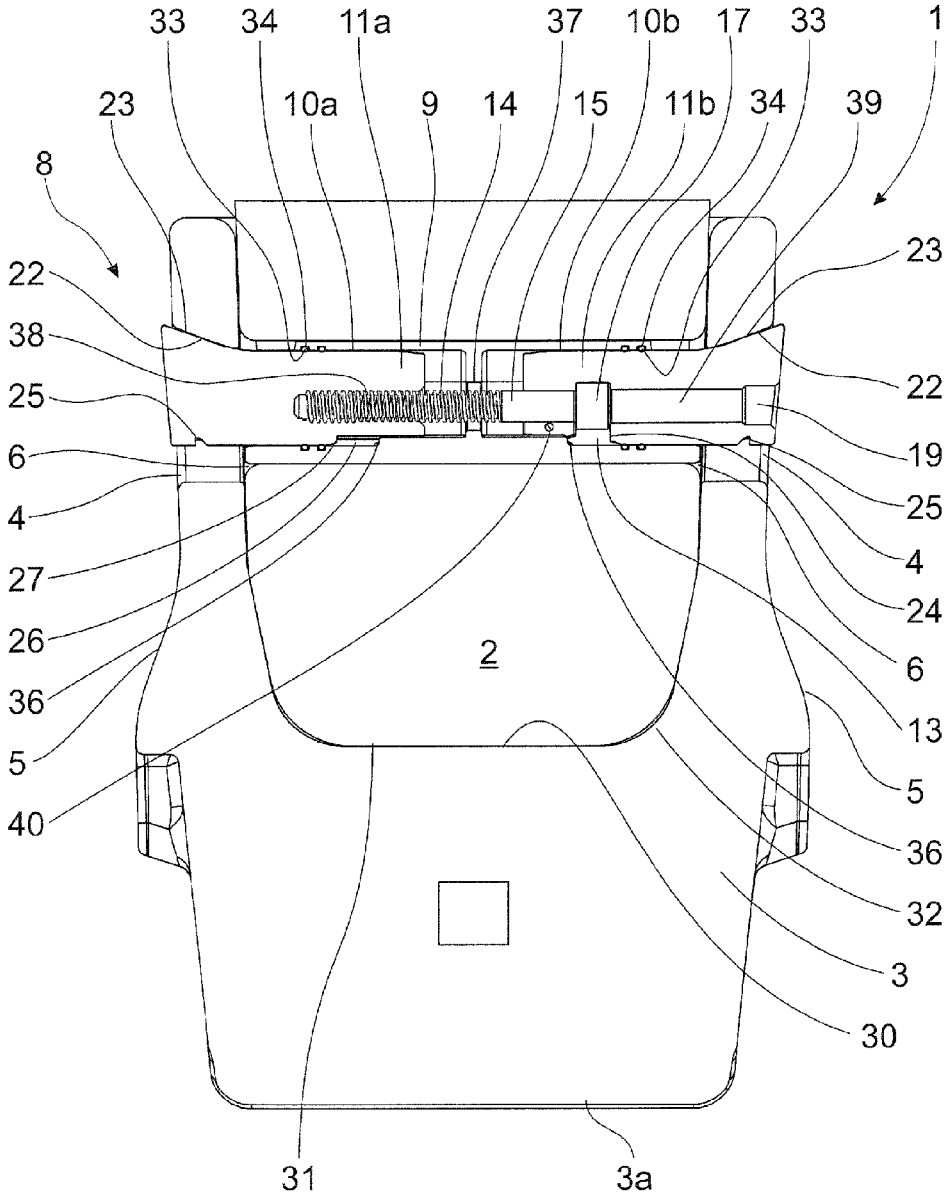
FIG. 2 shows a cross-sectional view of the excavator tooth assembly of FIG. 1 in an assembled state.

FIG. 2 shows a cross-sectional view in a horizontal plane through the excavator tooth assembly of FIG. 1 in an assembled state.

As can be seen, when bolt 14 is tensioned to a desired degree, the wedging engagement between the tapered portions 22 of locating members 10*a*, 10*b* and respective outwardly divergent tapering rearward walls 23 of side wall apertures 4 permits adaptor 3 to be drawn into tight engagement with nose 2 whereby the forward end 30 of nose 2 closely abuts an inner forward wall 31 of the nose locating socket cavity 32.

FIG. 2 shows in detail the configuration of the retaining pin assembly 8 wherein seal assemblies in the form of oval-shaped resilient sealing rings 33 are located in grooved recesses 34 formed on the inner surface of the interior aperture 12 in body member 9. These seals assist in preventing the ingress of moisture and/or earthen material which might otherwise cause binding between body member 9 and locating members 10*a*, 10*b* slidably located therein.

In the central region of the forward side of aperture 12 is an inwardly protruding portion 35 having shouldered abutments 36 which engage abutment 27 of locating member 10*a* and rear wall 24 of recess 13 of locating member 10*b* to limit the extent of inward movement towards each other. Also located within aperture 12 is a central wall 37 though which the shank of screw 14 extends. Also shown in FIG. 2 is the threaded bore 38 in locating member 10*a* into which bore the threaded portion of screw 14 extends and the axial bore 39 in locating member 10*b* through which the head 17 of screw 14 may be rotated to tighten or loosen the retaining pin assembly.

To prevent loosening of screw 14 during use and also to assist in maintaining screw 14 captive within the slot 16 and recess 13 of locating member 10*b*, a pin 40 is mounted in slot 16 through pin aperture 40A and engaging the opposed side wall of slot 16 such that pin 40 frictionally engages a shank portion 15 of bolt 14.

Figure 3:
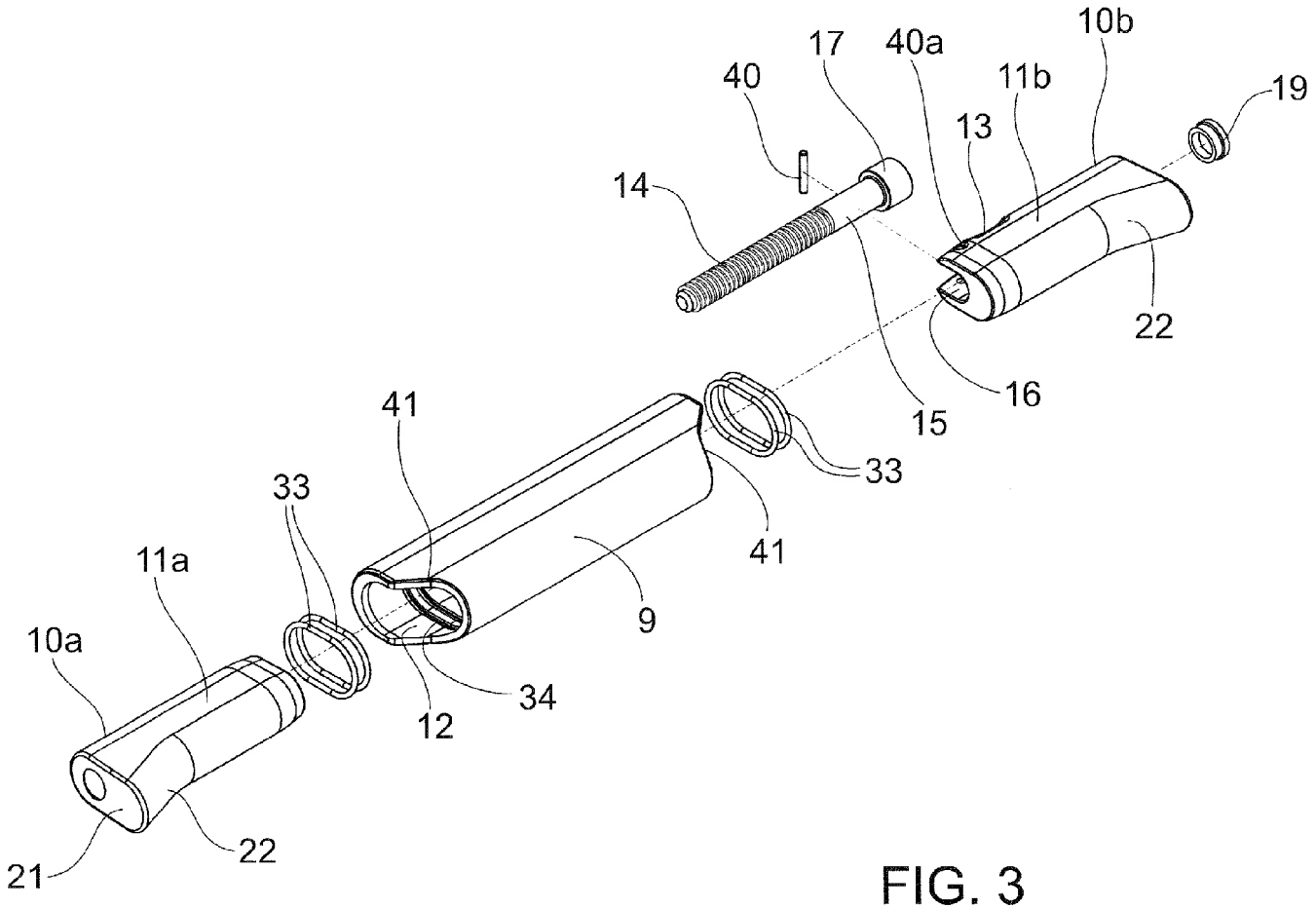
FIG. 3 shows an exploded view of a retaining pin assembly.

FIG. 3 shows schematically an exploded view of the retaining pin assembly 8 illustrated in FIGS. 1 and 2.

The generally oval cross-sectional shape of the wall of body member 9 has a relieved region 41 at each end to prevent contact with the inwardly convergent tapered regions 22 of locating members 10*a*, 10*b* when the pin assembly 8 is fully retracted.

Figure 4:
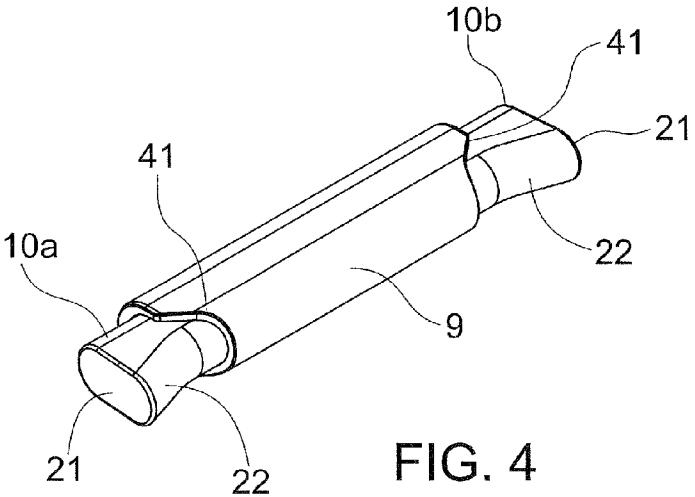
FIGS. 4 and 4*a* show schematically one embodiment of a retaining pin assembly.
Figure 4A:
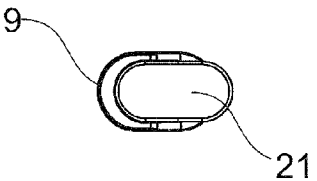

FIGS. 4 and 4*a* show schematically one embodiment of a retaining pin assembly.

FIG. 4 is an isometric view of a retaining pin assembly and FIG. 4*a* is an end elevational view thereof. As can be seen, the body member 9 has a generally oval-shaped cross-section as does the shank portions of locating members 10*a*, 10*b* slidably located therein. The outer ends of tapered portions 22 are of an elongated oval shape tapering inwardly to the oval shape of the shank portions of the locating members.

Figure 5:
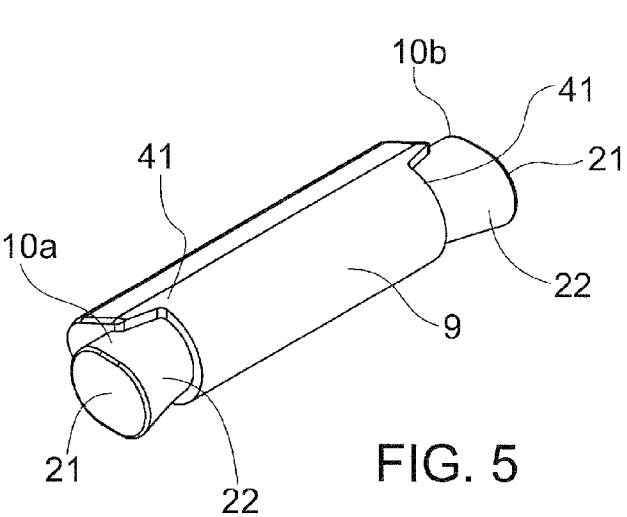
FIGS. 5 and 5*a* show schematically an alternative embodiment of a retaining pin assembly.
Figure 5A:
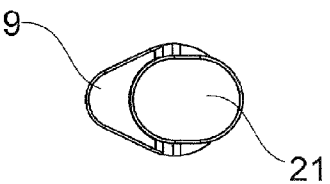

FIG. 5 is an isometric view of an alternative embodiment of a retaining pin assembly and FIG. 5*a* is an end elevational view thereof As shown, body member 9 has a generally tear drop-shaped outer cross-section and a generally cylindrical bore therein to slidably locate generally cylindrical shank portions of locating members 10*a*, 10*b*. The outer ends of tapered portions 22 are of an oval shape tapering inwardly to the generally cylindrical shank portions thereof.

The advantage of the tear drop cross-sectional shape over an oval cross-sectional shape is that with the tapering face portions of the mounting aperture converging in a forward direction, a greater thickness of metal between the interior of the mounting aperture 6 and the forwardly inclined front faces 50 of the nose 2 (illustrated in FIG. 1) is maximized thereby maximizing the strength of the nose in comparison to a nose having an oval-shaped cross-section mounting aperture.

Yet another advantage of the tear drop shaped cross-sectional shape of the retaining pin assembly is that in certain excavation environments, the build up of earthen fines within the mounting aperture can cause hydraulic "packing" between the retaining pin assembly and the mounting aperture and this, in turn, can lead to loosening of the adaptor on the nose. Because the surface area of the forwardly tapered portion of the tear drop shaped cross-section of the pin assembly and a corresponding region of the mounting assembly is much greater than the rearward surfaces, any tendency of fines to pack between the retaining pin assembly and the mounting aperture tends to cause a rearward and thus tightening force urging the adaptor further into engagement with the nose.

Figure 6:
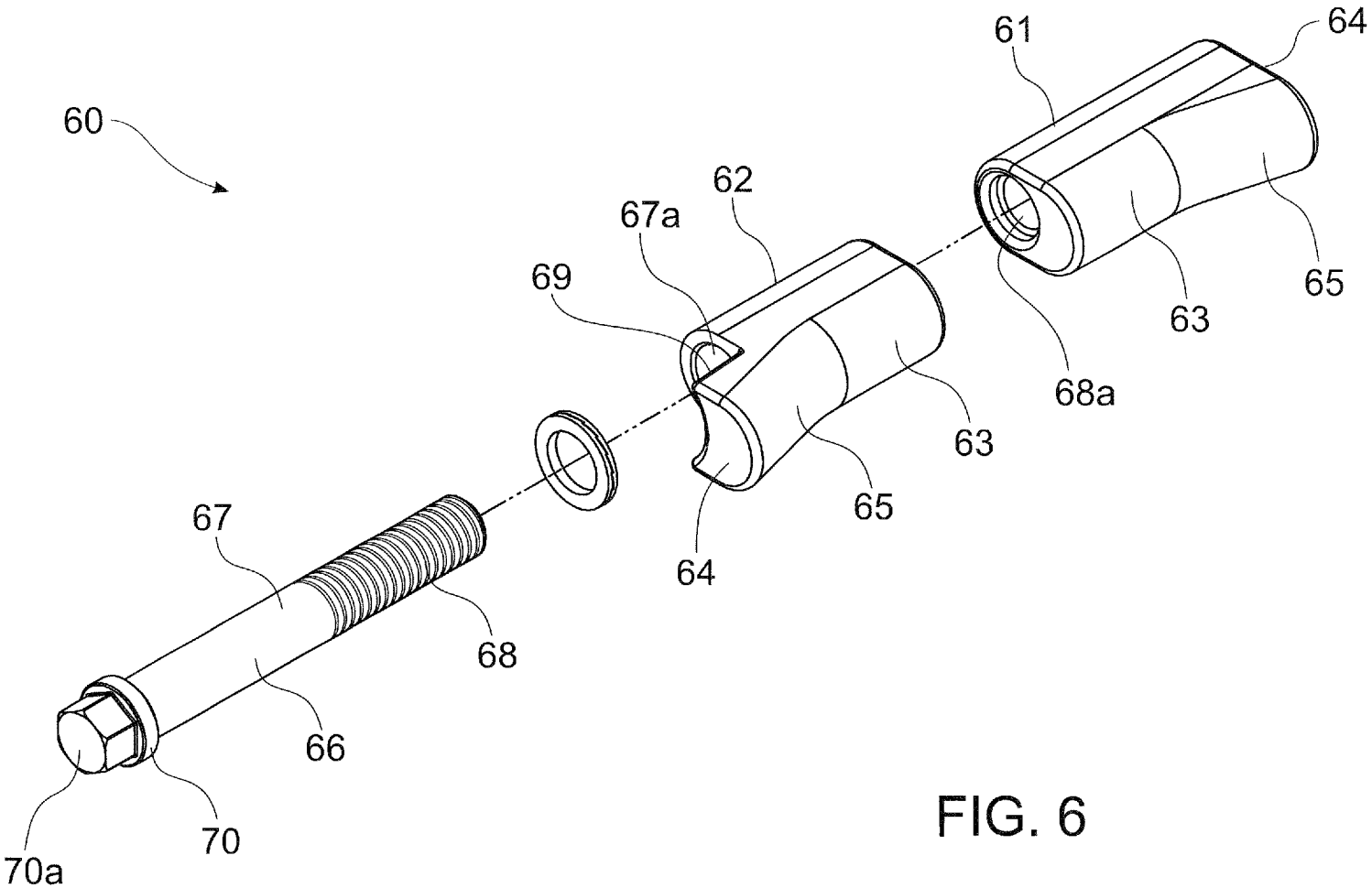
FIG. 6 shows a still further embodiment of a retaining pin assembly.

FIG. 6 shows an alternative embodiment of a retaining pin assembly 60.

In this embodiment, the assembly comprises opposed locating members 61, 62, each having a generally parallel sided shank portion 63 and an enlarged outer end portion 64 with an inwardly convergent tapered portion 65. A tensionable retaining member in the form of a screw-threaded cap screw 66 has an unthreaded shank portion 67 slidably located in a longitudinal aperture 67a in locating member 62 and a screw-threaded portion 68 located in an aligned screw-threaded aperture 68a in locating member 61. A recessed portion 69 in locating member 62 accommodates a head portion 70 of screw 66 when in situ with screw 66 under tension. A driveable portion 70*a* is located on head portion 70 to interact with and mate with a driven tool.

In a further variation of the embodiment shown in FIG. 6, an intermediate spacer member (not shown) having the same cross-sectional shape as the shank portions 63 may be located between locating members 61, 62 with the shank 67 of screw 66 extending longitudinally therethrough. Such a spacer member may assist in aligning the threaded portion 68 with the threaded aperture (not shown) of locating member 61.

Figure 7:
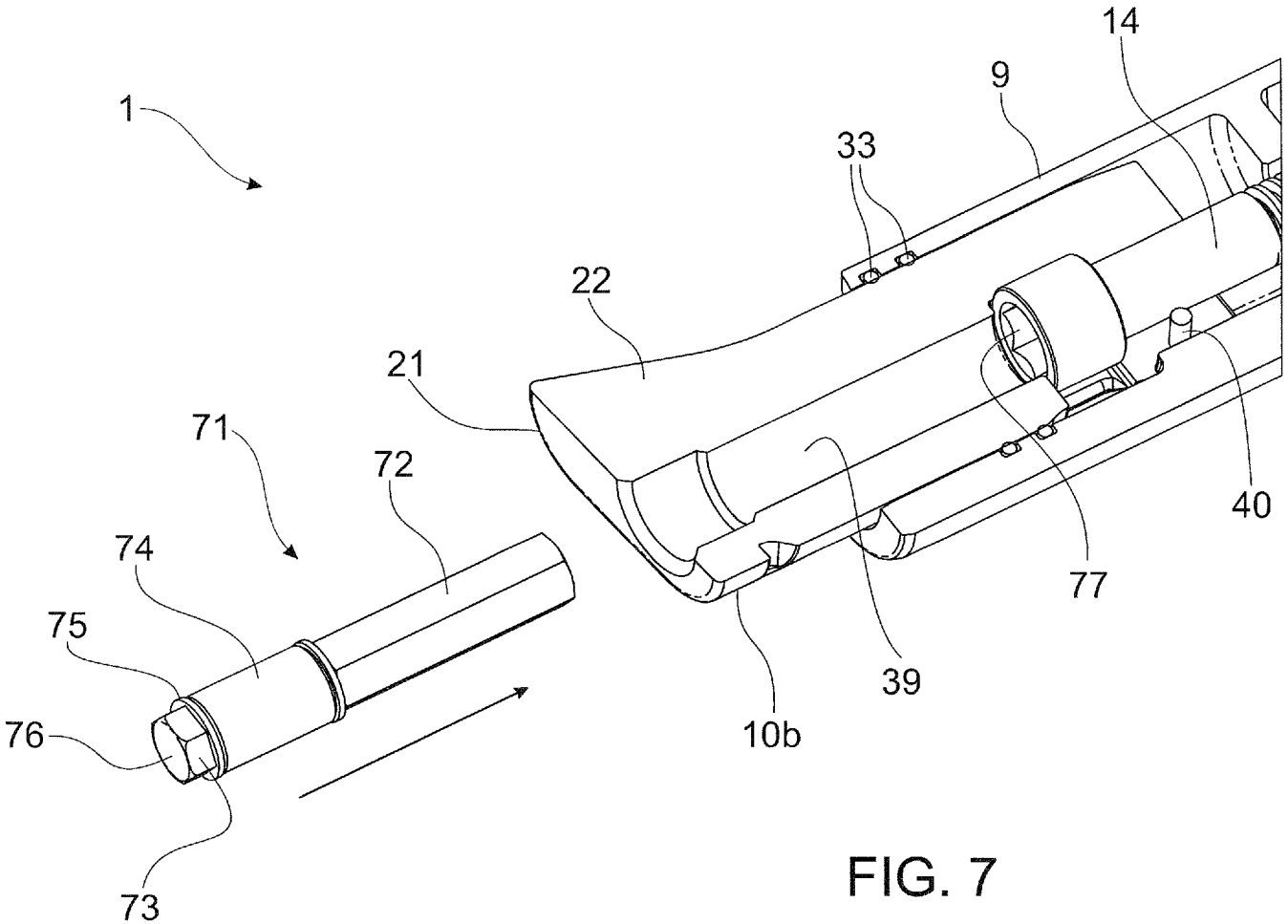
FIG. 7 shows an expandable plug assembly.

FIG. 7 shows an expandable plug assembly for use with various retaining pin assemblies according to the invention.

In the retaining pin assembly of FIG. 1, separate mechanisms 40, 19 are utilized to prevent loosening of screw 14 and packing of earthen material in the bore 39 (FIG. 2) respectively. FIG. 7 illustrates an alternative embodiment of the invention to combine both functions of resisting loosening of screw 14 and plugging the access bore 39.

As shown in FIG. 7, plug member 71 comprises a hexagonal shank portion 72 with a screw-threaded bore (not shown) extending longitudinally thereof. A hex headed screw 73 is threadably engaged in shank portion 72 with a resilient plastics or rubber sleeve 74 secured between the shouldered inner end of shank portion 72 and a bearing washer 75 abutting the hex head 76 of screw 73.

With the screw 73 loosely engaged in shank portion 72, the plug member 71 is inserted into bore 39 until the hexagonal shank portion 72 engages in the hexagonal socket 77 of screw 14. Utilizing a powered driver (not shown) with a hexagonal socket driver (not shown) engaged over the head 76 of screw 73, screw 73 is rotated while hexagonal shank portion 72 is prevented from rotation by engagement in the socket 77 of tensioned screw 14. As screw 73 rotates, a longitudinal compression force is applied to sleeve 74 which then undergoes radial expansion within bore 39. At a predetermined degree of rotational torque on screw 73, radially expanded sleeve 74 not only provides an effective seal to prevent ingress of water and earthen contaminants, the frictional engagement between bore 39 and sleeve 74, with hexagonal portion 72 engaged in socket 77 of screw 14 prevents loosening of screw 14.

It will be readily apparent to a person skilled in the art that the excavating tooth assembly, the retaining pin assembly and methods of use thereof in accordance with the invention offer substantial advantages over prior art systems and methods.

After a period of time in the field, some degree of wear between the wear member and the nose is inevitable. This wear usually occurs on upper and lower bearing faces of a nose and the front of a nose and the corresponding contact surfaces in the socket cavity of the wear member. When such wear occurs, any slack between the nose and wear adaptor is readily taken up by retensioning the bolt of the retaining pin assembly. The bolt is readily accessible and the complementary ramped engaging surfaces of the adaptor side wall apertures and the tapered portions of the locating members allows for a considerable degree of movement between the nose and wear member along a longitudinal axis with only a relatively small degree of rotation of the screw of the retaining pin assembly.

The various embodiments of the invention are quick and simple to install and uninstall with readily available tools and do not require severe impacts with a sledge hammer or the like which is a slow and dangerous procedure.

Whilst the invention has been described with reference to the mounting of a wear member to nose, it is equally applicable to the mounting of points or digging teeth to adaptors. Generally, teeth have wall apertures extending through opposed top and bottom walls and adaptors have a corresponding mounting aperture. A skilled addressee will appreciate that the retaining pin assembly of the invention may be employed to releasably secure a point or digging tooth to an adaptor.

It also will be readily apparent to persons skilled in the art that many modifications and variations may be made to the various aspects of the invention without departing from the spirit and scope thereof.

The invention claimed is:

1. An excavator tooth assembly comprising:

a mounting nose projectable from a digging edge of an excavator, said mounting nose including a mounting aperture extending laterally of said nose between opposite side walls thereof, said mounting aperture having a non-circular cross-section;

a wear member having a longitudinal axis, a forward end and a rearwardly opening socket for receiving said mounting nose, said wear member including opposed wall apertures communicating with a hollow interior of said socket, said opposed wall apertures being at least partially alignable with said mounting aperture; and, a retaining pin assembly non-rotatably located in said mounting aperture, said retaining pin assembly including a body member being configured to be non-rotatably located within the mounting aperture of said mounting nose prior to said wear member being mounted upon said mounting nose, locating members insertable via respective opposed wall apertures for slidable location in said mounting aperture relative to said body member, said locating members being retainable in said assembly by a tensionable retaining member extending between said locating members whereby an enlarged free end of each locating member is engagable with a wall of a respective opposed wall aperture.

2. The excavator tooth assembly of claim 1, wherein said mounting aperture has a generally oval shaped cross section.

3. The excavator tooth assembly of claim 1, wherein said mounting aperture has a generally tear drop shaped cross section.

4. The excavator tooth assembly of claim 1, wherein said opposed wall apertures have a generally oval shaped cross section.

5. The excavator tooth assembly of claim 1, wherein a longitudinal dimension of said opposed wall apertures is greater than a longitudinal dimension of said mounting aperture.

6. The excavator tooth assembly of claim 1, wherein at least a portion of a wall of at least one of said opposed wall apertures has an inwardly convergent tapered portion.

7. The excavator tooth assembly of claim 1, wherein said body member has a body aperture extending longitudinally thereof and is adapted to receive said tensionable retaining member.

8. The excavator tooth assembly of claim 1, wherein said enlarged free end of each said locating member is formed from an inwardly convergent wedge portion each adapted to abut and engage said wall of said respective opposed wall aperture.

9. The excavator tooth assembly of claim 1, wherein said tensionable retaining member comprises a screw threaded fastener, one of said locating members having a slotted aperture adapted to captively retain said screw threaded fastener therein.

10. A retaining pin assembly for an excavator tooth assembly, said retaining pin assembly comprising:

a body member being configured to be non-rotatably located within a transversely extending mounting aperture of a mounting nose of an excavator prior to a wear member being mounted upon said mounting nose;

opposable locating members each comprising a shank portion slidably insertable via a respective retaining pin aperture on opposite sides of the wear member into the transversely extending mounting aperture of the mounting nose, said locating members each having an enlarged inwardly convergent tapered wedge portion adjacent a normally outer end of a respective locating member; and a tensionable retaining member extending between said opposable locating members from one side of said retaining pin assembly whereby said body member is located intermediate of said locating members and tension applied to said retaining member causes relative contraction of said locating members to urge said wear member into engagement with said mounting nose by wedging engagement between each said wedge portion and a rear wall of respective retaining pin apertures.

11. The retaining pin assembly of claim 10, wherein each said shank portion and said transversely extending mounting aperture are of a non-circular cross sectional shape.

12. The retaining pin assembly of claim 10, wherein said body member comprises an aperture extending longitudinally thereof adapted to receive said tensionable retaining member.

13. The retaining pin assembly of claim 10, wherein said body member and said mounting aperture are of complimentary non-circular cross sectional shape.

14. The retaining pin assembly of claim 10, wherein said body member comprises a longitudinally extending body aperture adapted to slidably receive in opposite ends thereof a respective shank portion of said locating members.

15. The retaining pin assembly of claim 10, wherein said body aperture comprises a centrally located abutment.

16. The retaining pin assembly of claim 10, wherein said tensionable retaining member comprises a screw threaded fastener.

17. The retaining pin assembly of claim 15, wherein one of said locating members has a slotted aperture adapted to captively retain said screw threaded fastener therein.

18. The retaining pin assembly of claim 15, wherein a driver engagable head of said screw threaded fastener is accessible via a longitudinally extending bore extending at least partially between opposed longitudinal ends of one of said locating members.

19. A method of removably securing a wear member to a projecting mounting nose of a digging edge of an excavator, said method including the steps of:

inserting a body member within a mounting aperture of said mounting nose prior to said wear member being located upon said mounting nose;

locating on said mounting nose, the wear member having opposed wall apertures at least partially alignable with the mounting aperture of said mounting nose;

inserting through one said opposed wall aperture, a locating member having a screw-threaded aperture at an inner end and an enlarged outer end thereof;

inserting through an opposite opposed wall aperture, a further locating member such that said body member is located intermediate of said locating members, said further locating member having a screw-threaded fastener located therein, a said further locating member, a drivable head of said screw-threaded fastener being accessible via a bore extending through an enlarged outer end of said further locating member; and, coupling said screw-threaded fastener with said screw-threaded aperture of said one locating member whereby tensioning of said screw-threaded member causes relative contraction between said one locating member and said further locating member to prevent disengagement of said wear member.

20. The method of claim 19, wherein said enlarged outer end of each said locating member includes an inwardly convergent tapered portion which engages against a respective wall of said opposed wall apertures in said wear member to urge said wear member into engagement with said nose when said screw threaded fastener is tensioned.

21. The method of claim 20, wherein said opposed wall apertures include a complementary tapered portion to abut and engage with a respective tapered portion of a said locating member to urge said wear member into engagement with said nose when said screw threaded fastener is tensioned.

* * * * *